US007765654B2

(12) United States Patent
Weiner

(10) Patent No.: US 7,765,654 B2
(45) Date of Patent: Aug. 3, 2010

(54) CARPET TILE MANUFACTURING PROCESS

(75) Inventor: Robert S. Weiner, Atlanta, GA (US)

(73) Assignee: Product Concepts Residential, L.L.C., Dalton, GA (US)

( * ) Notice: Subject to any disclaimer, the term of this patent is extended or adjusted under 35 U.S.C. 154(b) by 236 days.

(21) Appl. No.: 12/118,962

(22) Filed: May 12, 2008

(65) Prior Publication Data

US 2009/0145534 A1 Jun. 11, 2009

Related U.S. Application Data

(63) Continuation-in-part of application No. 11/789,956, filed on Apr. 26, 2007, now Pat. No. 7,673,378, and a continuation-in-part of application No. 11/709,366, filed on Feb. 22, 2007.

(51) Int. Cl.
*D06C 23/02* (2006.01)
*D06C 13/00* (2006.01)

(52) U.S. Cl. ..... 26/16; 26/2 R

(58) Field of Classification Search ..... 26/7, 26/15 R, 16, 3, 4, 2 R, 69 R, 8 R, 9, 10 C, 26/8 C, 30; 83/939, 39, 52, 37, 875, 936, 83/938; 29/417, 91.1, 91.2, 412, 557; 219/121.19, 219/121.2; 28/143, 160, 163, 165, 170
See application file for complete search history.

(56) References Cited

U.S. PATENT DOCUMENTS

| | | | | | |
|---|---|---|---|---|---|
| 3,422,512 | A * | 1/1969 | Law | 26/16 |
| 3,761,675 | A * | 9/1973 | Mason et al. | 219/121.67 |
| 4,629,858 | A * | 12/1986 | Kyle | 219/121.69 |
| 4,649,606 | A * | 3/1987 | Fay | 26/15 R |
| 4,689,467 | A * | 8/1987 | Inoue | 219/121.6 |
| 4,766,745 | A * | 8/1988 | Johnston et al. | 68/200 |
| 4,793,033 | A * | 12/1988 | Schneider et al. | 26/16 |
| 5,016,328 | A * | 5/1991 | Gilpatrick | 26/7 |
| 5,211,805 | A * | 5/1993 | Srinivasan | 216/58 |
| 6,430,787 | B1 * | 8/2002 | Becan et al. | 26/16 |
| 6,854,146 | B2 * | 2/2005 | Stoyles et al. | 8/150 |
| 7,240,408 | B2 * | 7/2007 | Latos et al. | 26/2 R |
| 7,374,808 | B2 * | 5/2008 | Sellman et al. | 428/94 |

* cited by examiner

*Primary Examiner*—Amy B Vanatta
(74) *Attorney, Agent, or Firm*—Stephen J. Stark; Miller & Martin PLLC

(57) ABSTRACT

A method of producing a decorative carpet tile may include providing a carpet tile in accordance with the prior art techniques and then treating the carpet tile in one of various manners to provide a separation internal to side edges of the carpet tile. The treatment can include tip shearing side portions relative to an internal portion to provide at least one discontinuity, dripping colors to provide a frame, carving, burning, or otherwise providing a separation internal to the side edges of the carpet tile in various disclosed embodiments.

20 Claims, 3 Drawing Sheets

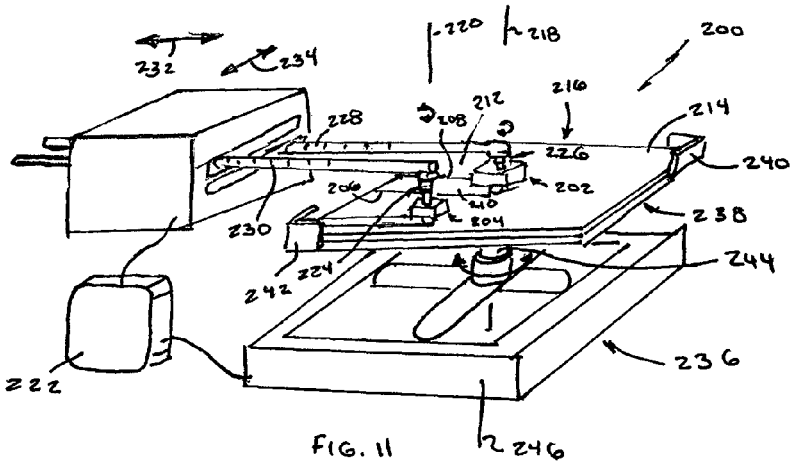
FIG. 11
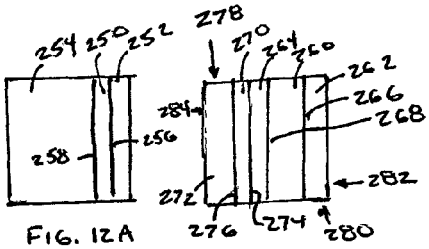
FIG. 12A
FIG 12B
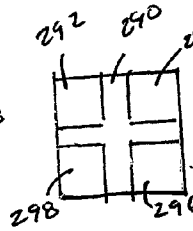
FIG 12C
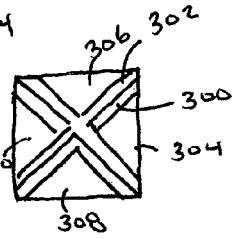
FIG 12D
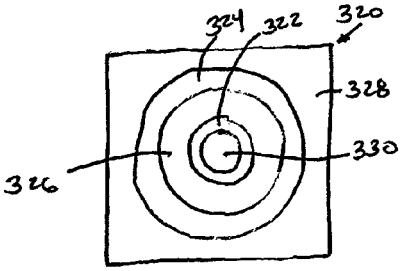
FIG 12E
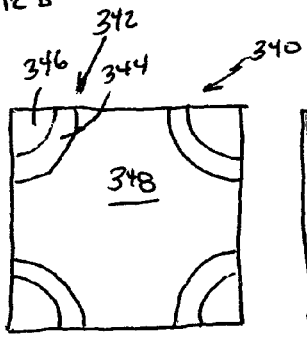
FIG 12F
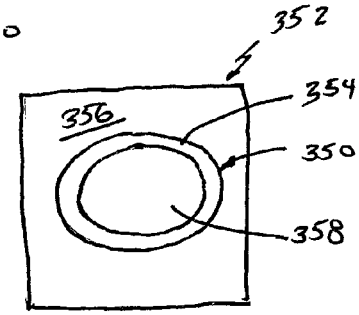
FIG. 12G

CARPET TILE MANUFACTURING PROCESS

CLAIM OF PRIORITY

This application is a continuation in part of both U.S. patent application Ser. No. 11/709,366 filed Feb. 22, 2007 and U.S. patent application Ser. No. 11/789,956 filed Apr. 26, 2007, now U.S. Pat. No. 7,673,378 both of which are incorporated herein by reference.

FIELD OF THE INVENTION

The present invention relates to a carpet tile and a method of its production wherein a carpet tile is configured to have a separation of at least one row or track relative to at least one second portion and more particularly to carpet tiles and method of production wherein a separation appearance is provided by at least one of tip shearing, cutting, burning, coloring or otherwise providing the appearance of a separation clearly defined internal to the boundary edges of the carpet tile after production of the tile from carpet rolls.

DESCRIPTION OF RELATED ART

Carpet tile has been made for many years by many different companies. In making carpet tile, carpet tile is typically made as carpet and then cut with a press to a specific dimension to provide carpet tiles. The edges are then normally trimmed substantially perpendicularly to an upper face of the carpet tile and the tile is then ready for distribution and installation. While many designs have been created over the years by various manufacturers, the applicant is unaware of carpet tile treatment methods performed after cutting the tiles apart with the one exception of treating side edges to attempt to ensure that no strands remain after a die cutting process which may otherwise leave a somewhat unattractive appearance at the side edges. More specifically, the applicant is unaware of any manufacturer that treats any upper surfaces of cut tile to provide aesthetically pleasing designs with a separation such as a track, stripe, or other design distinguishing at least some internal portions after the tufting process and after being cut into tiles.

Furthermore, although tip shearing carpet from carpet rolls is known in the art to tip shear across carpet at a predetermined height relative to the backing, this process causes the highest carpet to be sheared. The tips of these sheared portions are still at a highest point of the carpet and can be exposed to wear. When wear occurs, there is a tenancy for the ends to bend over, thus distorting the look over time.

Applicant's U.S. Pat. No. 7,146,693 relates to a method of utilizing an embossed roller which can cause patterns to be cut into carpet below what would otherwise be an upper surface of carpet. While that method is effective at producing patterns in carpet, the pattern on the roll or belt is what is produced in the carpet. Changing that pattern would require replacement with either another roll or belt. Furthermore, the tip shearing necessarily occurs in a single direction relative to a direction the carpet passes through the tip shearing/roller assembly. Changing direction of cut relative to the direction of travel for the carpet roll is not possible.

Also, in many prior art embodiments, clear separation from treated and untreated areas may be difficult as it is difficult to envision a situation where the backing could instantaneously change a predetermined height based on an embossed pattern on a roller, but instead would appear to take at least a limited distance to make this transition as the backing cannot make an instantaneous elevation transition. Finally, using this prior art process on individual tiles is not believed possible as an apparent void in equipment is believed to exist which could handle individual tiles as opposed to carpet rolls.

Accordingly, a new method of treating carpet and carpet tile is perceived to be advantageous over the prior art in order to provide new designs and configurations to the marketplace.

SUMMARY OF THE INVENTION

It is an object of the present invention to provide an improved carpet tile construction and method of its manufacture.

It is another object of at least some embodiments of the present invention to provide a method of tip shearing and/or carving at least a separation into a carpet tile in at least one presently preferred embodiment of the present invention.

It is another object of at least some embodiments of the present invention to provide at least one separation internal to edges of the carpet tile after cutting the carpet tile from a carpet roll.

In accordance with a presently preferred embodiment of the present invention a carpet after having been cut into a tile is preferably tip sheared or otherwise treated to provide an internal separation such as a stripe, track and/or design differentiating selected lower cut pile (side first portions) from the uncut or unselected pile (in internal second portions) separated by a discontinuity of the separation. The tip shearing process stops at the discontinuity which can provide a visible line parallel, or not, to the edge depending upon the orientation of the carpet relative to a cutting head during the cutting process. Parallel and/or intersecting effects may be provided using more than one cutting head and/or more than one pass. Programmable controllers and/or other positioners may be utilized to assist in positioning the cutting head and/or tile so that one or more designs can be cut or otherwise provided internal to edges of carpet tiles once cut from rolls of carpet.

Other methods of creating the illusion of a line of various selected widths or even varying widths can include carving, burning, or otherwise defining an internal line by treating side portions. Furthermore, dripping and/or overdying, a design and/or creating a line could also be provided. When utilized with other similarly prepared tiles, a series of designs can provide additional effects, or even cooperating effects, which heretofore is not believed to have been done in the prior art.

BRIEF DESCRIPTION OF THE DRAWINGS

The particular features and advantages of the invention as well as other objects will become apparent from the following description taken in connection with the accompanying drawings in which:

FIG. 11 is a top perspective view of another alternatively preferred equipment showing the process of producing framed carpet tiles in accordance with a presently preferred embodiment of the present invention; and FIGS. 12A-12G are top plan views of various embodiments formed using the equipment shown in FIG. 11.

DETAILED DESCRIPTION OF THE PREFERRED EMBODIMENT

Figure 1:
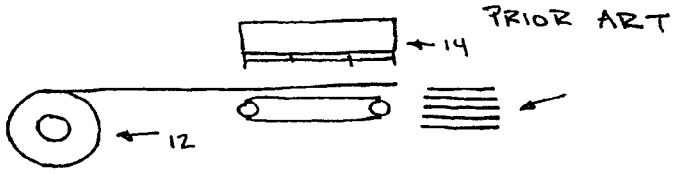
FIG. 1 is a diagrammic representation of a prior art method of cutting carpet tiles from a roll of carpet.

FIG. 1 shows a prior art diagrammic representation of a method of making carpet tiles 10 as would be known by one of ordinary skill in the art. Carpet from a roll 12 is directed to a die 14 where individual carpet tiles are produced by cutting. In the prior art, trimming edges with an edger to attempt to remove loose yarn was performed, but there was not believed to be a further effort to tip shear or otherwise treat upper surface portions of carpet tiles 10 once cut with the die 14.

The applicant has developed a manufacturing process 20 from which carpet tiles 10 such as carpet tiles 10 can be placed at entry 22 and directed towards a first station 24 which is illustrated treating upper surfaces one of the four sides 26 of carpet tile 28 and it proceeds through the process 20. Specifically, instead of being located to treat an edge of the carpet tile edger 30, an edger 32 or other treatment apparatus has been turned 90 degrees relative to edger 30. In this manner edger 32 effectively tip shears an outer or side portion 34 seen in FIG. 3A. Edger 30 then edges the side as has been known in the prior art which potentially removes strands of yarn but does not tip shear or otherwise treat an upper surface of the carpet internal to edge 36 as is contemplated by the presently preferred embodiment. In some embodiments this is a finished product.

Figure 2:
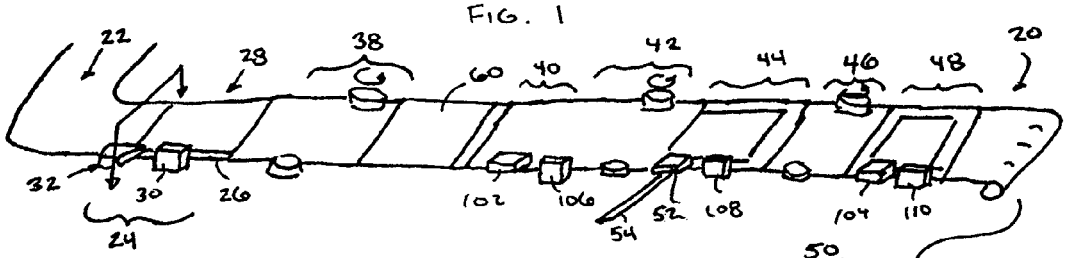
FIG. 2 is a top perspective view of a process of producing framed carpet tiles in accordance with a presently preferred embodiment of the present invention.

In other embodiments, the carpet proceeds from the first station 24 to the first turning station 38 which turns the carpet tile 28 ninety degrees to the position shown in the first station 24 as it is fed into the second treatment station 40 where a second side portion is treated. Once again, this could be a finished product or could then proceed to a second turning station 42 then to a third treatment station 44 and then possibly to a third turning station 46 and to a fourth treatment station 48 before being deposited as a framed carpet tile 50 as illustrated in FIG. 2. The third treatment station 44 shows an alternatively preferred feature relative to the other three cutting stations 24,40,48 in that the cutter 52 is located on a slide 54 so that it can slide in and out to create various effects in the frame such as scalloped edges 56 shown in FIG. 6 or even points 58 or other features as would be desired. It also provides for adjustable thicknesses of side portions 34 and/or desired placements of frame 70 relative to carpet tile perimeter 102. Although only the third treatment station 44 is shown having this capability, those of ordinary skill would know all the treatment stations 24,40,44,48 could have this capability in other embodiments.

Figure 9:
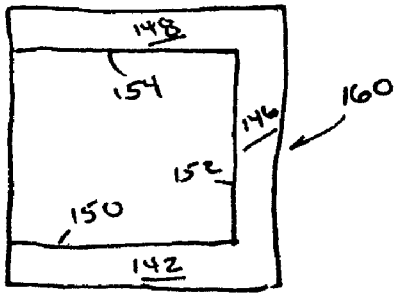
FIG. 9 is a top plan view of a fifth alternatively preferred embodiment with three of four sides treated.
Figure 10:
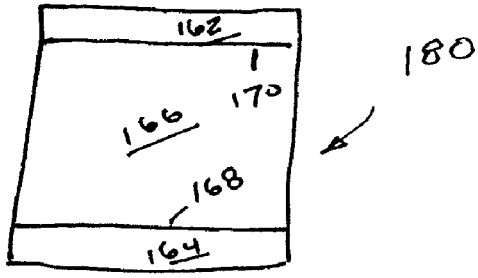
FIG. 10 is a top plan view of a sixth alternatively preferred embodiment with treated opposite sides.

Additionally, although four separate cutting stations 24,40, 44,48 are illustrated as would be understood by one of ordinary skill in the art, it may be possible to have two stations operate at the same time such as cutting parallel side portions at the same time (i.e., opposing sides) such as to provide the embodiment illustrated in FIG. 10. Furthermore, in other manufacturing practices, it may be possible to have one or more treatment stations perform all of the desired treatments in one or more steps. The applicant has found that the process 20 illustrated has been found to be a particularly attractive way of producing an attractive framed carpet tile 50 and that portions of the process so attractive for the embodiments of FIGS. 7-10.

Figure 3A:
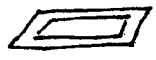
FIG. 3A is a cross-sectional view taken along line A-A of FIG. 2.
Figure 3A:
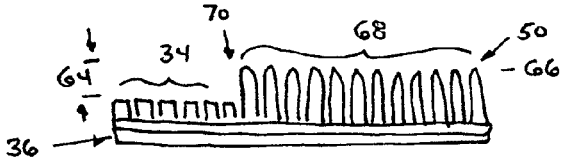
Figure 3B:
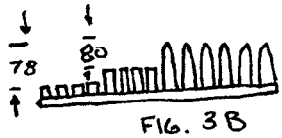
FIG. 3B is a cross-sectional view taken along line A-A of a first alternative embodiment of FIG. 2.
Figure 4A:
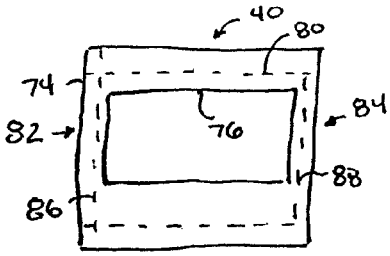
FIG. 4A is a top plan view of the embodiment of FIG. 3B.
Figure 4B:
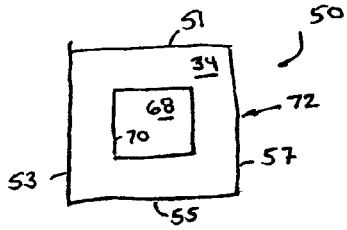
FIG. 4B is a top plan view of the embodiment of FIG. 3A.

As one can see from FIG. 3A, which reflects the cross section A-A in FIG. 2 of a carpet tile 28 as it is proceeding through the process 20, the cutter 32 cuts side portion 34 to a depth 64 lower than an elevation 66 of uncut portion 68 thereby providing a noticeable separation 70 forming a portion of a frame intermediate the side portion 64 and the interior portion 68 (it will be understood that other portions of the interior portion 68 will be treated through the process 20). This separation 70 can be better seen as interior parallel lines in FIG. 4B which can define a rectangle to provide a framed tile 50 as shown in FIGS. 2, 3A and 4B which in some embodiments is shown in a square internal to and centrally disposed relative to external square design of the perimeter 72 of the carpet tile 50 shown in FIG. 4B. The perimeter of carpet tile 50 has first, second, third and fourth edges 51,53,55,57. The alternate embodiment shown in FIG. 4A has a perimeter 74 which is identical to that of perimeter 72 but can be of any other shape as carpet tiles are known to be produced. The internal frame perimeter 76 is rectangular but not square due to a difference in the thickness of side portions 34 as cut during the process 20. Additionally, as shown in FIGS. 4A and 3B, more than one elevation differential illustrated as first depth 78 and second depth 80 can provide a second frame perimeter 80 or even just separate line 80 which may not be a compete perimeter but may instead proceed from first edge 82 to second edge 84 such as if segments 86 and 88 are not cut to first depth 78 as would be understood by one of ordinary skill in the art. This could add even further additional effects which gave rise to the embodiments of FIGS. 7-10.

Figure 6:
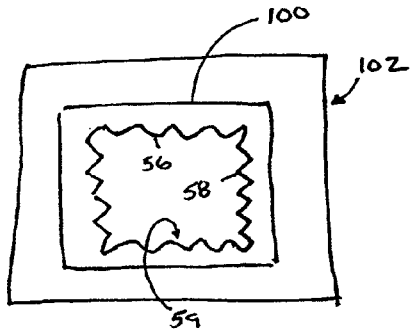
FIG. 6 is a top plan view of a second alternatively preferred carpet tile embodiment.

It may be important for one of ordinary skill in the art to remember that a design has likely been tufted into the carpet tiles 50,90 during the tufting process and/or over dyed either before the process 20 or after so that the effect of creating at least a portion of the internal frame designed by perimeter 70 and 76 as well as 56 and 58 in the embodiment of FIG. 6 is believed to add dramatic effects than previously performed methods.

Figure 5:
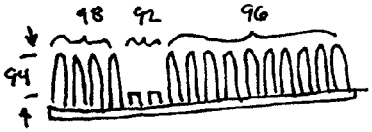
FIG. 5 is a cross-sectional view taken along line A-A of an alternatively preferred embodiment.

FIG. 5 shows a cross-sectional view of another embodiment which could be similar to that illustrated in 4B where a portion 92 is cut, carved, burned or otherwise provided a depth 94 into the carpet to distinguish section 92 from adjacent sections 96 and 98. In addition to cutting and carving, other frames may be provided in other embodiments in conjunction with removal of carpet as has been described above or with coloring by dripping or otherwise providing a coloration of a post treatment after cutting the tiles 10 in a new manner that has not believed to have been previously performed in the prior art. Discontinuity can result from post tufting coloring, carving, burning, cutting, etc., to create a visible discernment from interior portion 68 and at least a portion of side portion 34.

FIG. 6 shows an internal perimeter 59 similar to perimeters 70,76 in that which would be defined by segments such as 56 and 58. This perimeter 59 is not parallel to edges like 51,53, 55,37. Perimeter 59 could be provided as could be shown in FIG. 2 at third station 44 or otherwise to provide a non-linear treatment to side portions to provide this or other frame types. Furthermore, although the internal perimeter defined by 56 and 58 is not linear, it is possible that a second perimeter 100 could be created which is (or is not) linear in conjunction with the non-linear internal perimeters defined by segments 56,58 or others.

Frames such as looking at FIG. 4B could include the entire side portion 34 as well as a discontinuity 70. In other embodiments it may just include the discontinuity 70 and/or other portions such as the cut portion 92 carved in FIG. 5 which may be cut, burned, or otherwise provided. In yet other embodiments, still other frames may further distinguish internal portion 68 relative to side portions 34 or portion side portions 34 as would be understood in the art. Frames as here defined do not include tufted differences such as if a square pattern were tufted internal to a side portion such as with high and low loops as technology exists to be able to provide that as a design. Furthermore, frames may be provided prior to cutting into tile such as by carving or tip shearing the side portions 34 relative to non-tip sheared internal portions 68 and then cutting into carpet tile in other embodiments.

In the presently preferred embodiment, cutters such as shown at 32,102,52 and 104 are utilized to provide the side portion 34 relative to interior portions 68. The applicant has used a cutting head which is about 2 to 4 inches across which terminates at a sharp cut at junction 70 relative to uncut portion 68 as shown in FIG. 3A. Depending on its placement side portions 34 have been set from ¼ to 4 inches but other dimensions are also possible. Other embodiments may utilize other structures for treatment stations including carvers, burners, applicators, etc., as would be known by those of ordinary skill in the art. The cutters 32,102,52 and 104 are edgers such as edger 30,106,108 and 110 turned 90 degrees to the normal positioning used to trim loose unkempt yarns from edges 51,53,55,57 and not the upper surface of the carpet tile 50.

By providing this method of treating carpet tiles, new and exciting textures and designs are believed to be available to the market which have not previously been provided.

While the framed carpet tiles 40,50 and 102 provide unique products for the marketplace, the applicant discovered while making the framed tiles 40,50,102, that all four sides need not necessarily be treated to provide unique effects presently unavailable in the market. Specifically, FIGS. 7-10 show additional embodiments that can be taken at various stages of the manufacturing process as shown in FIG. 2.

Figure 7:
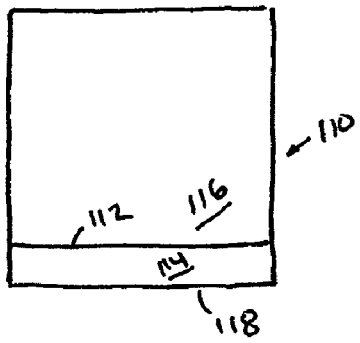
FIG. 7 is a top plan view of a third alternatively preferred embodiment with a single side treatment.

FIG. 7 shows tile 110 having separation 112 distinguishing first portion 114 from second portion 116. Just like has been described above, the preferred method is to tip shear anywhere from about a quarter inch to up to several inches, such as four, from edge 118 to provide first portion 114 as a band defined by separation 112 relative to second portion 116. It is important to remember that in many embodiments, a design of some type will have been tufted and/or dyed into the carpet tile 110 whereby the band provides an additional aesthetic element. When tile 110 is combined with similar or dissimilar tiles 110, such as tiles 120, 140, and/or 160, striking effects can be created whether or not the other tiles 110, 120, 130 or 140 are provided with similar or dissimilar designs and/or coloration schemes.

Separation 112 may be gradual in other embodiments, but in the illustrated embodiment of FIG. 7 is where the edger 32 tip sheared first portion 114 relative to non-treated portion 116. Separation 112 need not be parallel to edge 118 in all embodiments, and need not necessarily be linear in all embodiments, either.

Figure 8:
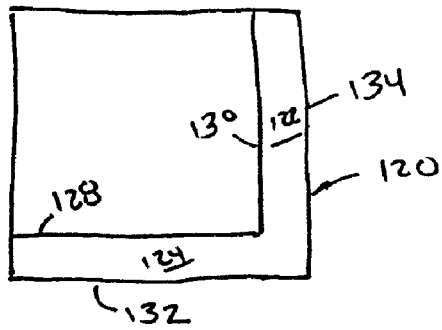
FIG. 8 is a top plan view of a fourth alternatively preferred embodiment with treated adjacent sides.

Using the same basic methodology of making the tile 110 of FIG. 7, tile 120 of FIG. 8 can be made with treatment of third portion 122 relative to at least one of first and second portions 124, 126, respectively. In the illustrated embodiment first and third portions 122, 124 are treated to a similar height so there is no distinguishable separation there between, but this need not be the case for all embodiments. Separations 128 and 130 separate first and third portions 122, 124 from second portion 126. In the illustrated embodiment an "L" shape or "chevron" shape is provided which provides somewhat unique effects when combined with any of the other effects and/or tiles 40,50, 102 of embodiments of FIGS. 7-10 and/or 4A, 4B and/or 6.

Separations 128 and 130 are shown parallel to edges 132 and 134 in the illustrated embodiment. Other embodiments may include these and/or additional effects.

FIG. 9 shows a "U" or "C" style tile 140 with first, third and fourth portions 142, 146, 148 separated from second portion 144 by separations 150, 152, 154. Additional separations could separate any of the first, third or fourth portion 142, 146, 148 from each other such as by varying the amount of tip shearing, or other treatment process.

FIG. 10 shows two treated portions 162, 164 spaced by untreated portion 166 as can be visually distinguished by separations 168, 170.

As one skilled in the art will quickly recognize, the installer will have a host of new options when selecting from the embodiments of FIGS. 4A, 4B, 6, and 7-10 especially if features from those respective embodiments are combined together. The embodiments of FIG. 7-10 can be made using the process 20 of FIG. 2 by simply de-activating selected cutters 32, 102, 52 and/or 104 may not be utilized at a particular station. Of course the number of stations 24, 40, 44, 48 can be reduced as well as would be understood by those of ordinary skill in the art.

FIG. 11 shows an alternative embodiment of a carpet tile treatment station 200 which can be utilized to treat individual tiles in the presently preferred embodiment. Carpet tile treatment station 200 has one or more treatment devices 202,204 which impart one or more separations 206,208 to distinguish first portion 210 relative to second portion 212 in the embodiment of a cutter. The cutter can tip shear first portion 210 relative to the second portion 212 and thereby establish separations 206,208 distinguishing the two portions at the upper surface 214 of carpet tile 216 where the treatment agents 202,204 are configured to treat the carpet tile 216. In the illustrated embodiments treatment agents 204,206 may be positionable about respective axes 218 and 220 either by being manually set in a desired position and/or being programmably controllable and/or otherwise positionable such as with controller 222 which could be computer PLC or other controller 222 coupled to a Servo and/or other device and possibly may also adjust the relative elevation of treatment agents 202,204 such as by having piston members 224,226 extend or retract treatment devices 202,204 relative to the upper surface 214 of the carpet tile 216. Heights may be preset, adjustable and/or programmably adjustable.

Furthermore, it may be possible to move the treatment devices 202,204 or not relative to the carpet upper surface 214 the carpet tile 216 such as with extension arms 228,230 or otherwise. Extension arms 228,230 may be movable along axis 232 and/or parallel to axis 232 and/or movable parallel to or on the axis 234 as would be obvious to one of ordinary skill in the art. The illustrated embodiment shows just one mechanism of three dimensional movement of treatment devices 202,204. Two dimensional movement and/or three dimensional movement through other mechanisms may also be desirable and/or provided in other embodiments and which could be accomplished by means as known to those of ordinary skill in the art.

In addition to and/or instead of moving the treatment devices 202,204, carpet tiles can be moved such as are shown in FIG. 2 relative to the treatment device such as with a turntable or moving station 236. Moving station 236 preferably provides a support 238 to which a carpet tile 216 can be placed. Retainers 240,242 may be utilized to maintain the carpet tile 216 in contact with support 238 and can take various forms such as clamps, framed ends or other mechanisms as known to those of ordinary skill in the art.

It may also be possible that texture of an upper surface of support 238 may sufficiently cooperate with a lower surface of carpet tile 216 to hold the carpet tile 216 in a desired location during treatment. Treatment station 236 may have a post member 244 at least partially rotatable around an axis 246. Axis 246 may be movable or fixed depending on the various embodiments utilized. In the illustrated embodiment post 244 is movable parallel to axis 232 and 234 such that possibly in combination with controller 222 so that the desired movement of the carpet tile 216 relative to the treatment devices 202,204 could be affected as so desired. Conveyors and/or other moving station components could be employed with other embodiments. Controller 222 may be provided with a plurality of design options such as from a storage device to assist in providing a particular design on carpet tile 216.

In the illustrated embodiment of FIG. 11, either or both of the treatment devices 202,204 and the carpet tile 216 can be moved in relative relationship relative to one another. Post 244 also is illustrated having a piston style construction whereby elevational adjustment of the upper surface 214 of the carpet tile 216 relative to the treatment devices 202,204 can be provided. Other elevation adjustment mechanisms could be employed in other embodiments.

Exemplary embodiments and designs are shown in FIGS. 12A-12G, but still others can be created. Specifically, FIG. 12A shows a first portion 250 distinguished from second portions 252,254 by a first separation 256 and second separation 258.

FIG. 12B shows a construction with first portion 260 separated from second portions 262,264 by first separation 266 and second separation 268 as well as a third separation 270 separated from second portion 264 and another second portion 272 by third separation 274 and fourth separation 276. Notice that the third portion 270 and first portion 260 are different widths in these illustrative embodiments. The applicant envisions widths could vary in range of about half an inch to about three inches depending on the particular treatment device 202,204 selected for that particular application. Still other widths could be selected. About three inches or less has been found to be particularly attractive for some embodiments in that once subjected to wear by foot traffic, a portion of the foot traffic is still directed to second portions such as 262,264,272 which can absorb a significant portion of the load to thereby prevent untimely wear of the tip sheared portions. If a cutter is utilized, first portion 260 and third portion 270 could be protected from excessive traffic thereby potentially prolonging the life of the carpet tile illustrated in FIG. 12B.

In both FIGS. 12A and 12B, the first portion 260 and third portion 270 run from first side edge 278 to third side edge 280 which are parallel to side edges 282 and 284. In other embodiments, this may not necessarily be the case. FIG. 12C shows another alternative embodiment which a "plus" style design is illustrated with first separations 290 separated from second portions 292,294,296 and 298.

FIG. 12D shows yet another embodiment in which first portions 300 and 302 are shown separated from second portions 304,306,308,310 by illustrated separations. Note that first portion 302 is cut deeper relative to upper surface 214 shown in FIG. 11 and first portion 300 thereby giving yet another effect. This design also is provided on a diagonal and may be cut on the diagonal for at least some embodiments.

FIG. 12E shows designs provided on carpet tile need not necessarily extend from side edge to side edge but can be internal to the carpet tile 320. In this design first portion 322 represents a circle cut internal to the carpet tile 320. Third portion 324 and first portion 322 are separated from second portions 326,328 and 330. Of course, in other embodiments a single circle could be provided, other circles provided and/or even more circles could be provided to distinguish from second portions. The treatment devices 202,204 and/or carpet tiles 320 can be moved relative to one another to assist in providing the design.

FIG. 12F shows another embodiment in which it would be understood by those of ordinary skill in the art that carpet tile 340 could cooperate with similar tiles 340 to provide a continuous design. Quarter circles 342 of first portions 344 are distinguished from second portion 346 and 348. To form a circle configuration the first portion 344 would combine with three other carpet tiles 340 meeting at a common corner. Of course, all the other designs and configurations could also be provided as would be understood by those of ordinary skill in the art.

FIG. 12G shows an oval 350 internal to carpet tile 352 having first portion 354 separated from second portion 356 and 358. Utilizing this technology, a whole host of different designs could be provided having varying effects. It is important to remember that these embodiments as utilized with the treatment station 200 shown in FIG. 11 that all carpet tile treatment preferably occurs after the carpet tile is created from rolls of carpet.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of manufacturing a decorative carpet tile comprising:

providing a carpet tile tufted to at least one height with first, second third and fourth side edges forming a rectangular perimeter, said carpet tile having an upper surface; and then tip shearing at least one first portion of the upper surface of the carpet tile at a treatment station to provide a first separation internal to the rectangular perimeter providing a first portion distinguished relative to a second portion by the first separation wherein the treatment station moves in at least one of an X and Y direction simultaneously with tip shearing and the at least one first portion is lowered to an elevation below the second portion by the step of tip shearing.

2. The method of claim 1 wherein during step of treating the at least one portion of the upper surface the treatment station rotates.

3. The method of claim 1 further comprising the step of simultaneously treating the upper surface to provide a third portion at least partially defined by a second separation with a second treatment agent spaced from the first separation while tip shearing the first portion with a first treatment agent.

4. The method of claim 3 wherein the second separation is parallel to the first separation as a result of the treatment step.

5. The method of claim 4 wherein the second separation is parallel to one of the first, second, third and fourth side edges as a result of the treatment step.

6. The method of claim 5 wherein the second separation extends from one of the first side to the third side and the second side to the fourth side as a result of the treatment step.

7. The method of claim 1 further comprising a step of simultaneously tip shearing the carpet tile to provide a second separation at least partially defining a third portion distinguished from the second portion.

8. The method of claim 1 wherein the elevation of the first portion changes along the first portion.

9. The method of claim 7 wherein the treatment step further provides a third separation spaced from the second separation with the second and third separations defining the third portion therebetween internal to the first, second, third and fourth side edges.

10. The method of claim 9 wherein the first and third separation are parallel as a result of the treatment step.

11. The method of claim 1 wherein a first portion provides a curve relative to at least one of the first, second, third and fourth side edge.

12. The method of claim 11 wherein the first portion is treated at a treatment station with a treatment device moved relative to the carpet tile.

13. The method of claim 11 further comprising the step of turning the carpet tile while treating the carpet tile with a treatment device.

14. The method of claim 13 wherein the carpet tile is rotated about an axis while turning.

15. The method of claim 11 further comprising the step of providing a programmable controller operably coupled to at least one of a support supporting the tile during the treatment and to the treatment device wherein the programmable controls at least assists in providing a design on the carpet tile by moving at least one of the tile and the treatment device in accordance with a pre-programmed design pattern.

16. The method of claim 6 wherein the carpet tile is rotated while tip shearing the carpet tile.

17. A method of manufacturing a framed carpet tile comprising:

providing a carpet tufted to at least one height with an upper surface;

cutting carpet tile from the carpet defined by first, second third and fourth side edges forming a rectangular perimeter; and then tip shearing a first portions of the upper surface of the carpet tile with a first treatment device to provide first separation internal to the rectangular perimeter of the carpet tile with the first portion distinguishably separated by the first separation relative to a second portion while simultaneously tip shearing a third portion of the upper surface of the carpet tile with a second treatment device spaced from the first treatment device to provide a second separation internal to the rectangular portion of the carpet tile with the third portion distinguishably separated by the second separation relative to a fourth portion.

18. The method of claim 17 wherein the carpet tile cut from the carpet is cut into squares.

19. The method of claim 17 wherein the step of tip shearing first and third portions of the upper surface of the carpet tile is performed while moving the carpet tile.

20. The method of claim 17 wherein during the step of tip shearing the upper surface of the carpet tile, a programmable controller directs relative movement between a treatment agent and a carpet tile.

* * * * *